US006412429B2

(12) United States Patent
Foresman

(10) Patent No.: US 6,412,429 B2
(45) Date of Patent: Jul. 2, 2002

(54) EXTENDED LIFE TRAVELING GRATE SIDE PLATE

(75) Inventor: James D. Foresman, Hughesville, PA (US)

(73) Assignee: Svedala Industries, Inc., Waukesha, WI (US)

( * ) Notice: Subject to any disclaimer, the term of this patent is extended or adjusted under 35 U.S.C. 154(b) by 0 days.

(21) Appl. No.: 09/803,784

(22) Filed: Mar. 12, 2001

Related U.S. Application Data

(60) Provisional application No. 60/191,650, filed on Mar. 23, 2000.

(51) Int. Cl.[7] ..... F23H 17/00

(52) U.S. Cl. ..... 110/327; 110/328; 198/822; 126/152 B

(58) Field of Search ..... 198/822, 853, 198/851; 474/234; 432/137, 251, 247, 248; 110/267, 268, 269, 271, 275, 278, 281, 286, 327, 328, 329; 126/152 B, 152 R

(56) References Cited

U.S. PATENT DOCUMENTS

| | | | | |
|---|---|---|---|---|
| 2,006,612 A | | 7/1935 | Williams | 263/8 |
| 3,563,520 A | | 2/1971 | Muller | 263/28 |
| 3,782,533 A | | 1/1974 | Hartwig | 198/196 |
| 3,840,112 A | * | 10/1974 | Hartwig | 198/202 |
| 3,841,829 A | | 10/1974 | Korting | 432/245 |
| 3,842,763 A | | 10/1974 | Korting | 110/40 |
| 4,697,696 A | * | 10/1987 | Howe et al. | 198/822 |
| 4,991,710 A | * | 2/1991 | Imatomi | 198/822 |
| 5,439,751 A | | 8/1995 | Fesler | 428/614 |

* cited by examiner

*Primary Examiner*—Ira S. Lazarus
*Assistant Examiner*—K. B. Rinehart
(74) *Attorney, Agent, or Firm*—Andrus, Sceales, Starke & Sawall, LLP

(57) ABSTRACT

An extended life traveling grate side plate having a heat transfer opening formed in a front portion of the side plate. The side plates are attached to the lateral side surfaces of each chain in a traveling grate conveyor. The front portion of each side plate overlaps the back portion of the preceding side plate such that the back portion of each side plate is covered and prevented from radiating heat away from the side plate. The heat transfer opening formed in the front portion of each side plate facilitates greater heat transfer from the overlapped area of the side plate. The front portion of the side plate is generally planar and does not include any gussets, thereby eliminating the heat transfer properties of the gussets and creating a more uniform thermal expansion of the side plate.

9 Claims, 6 Drawing Sheets

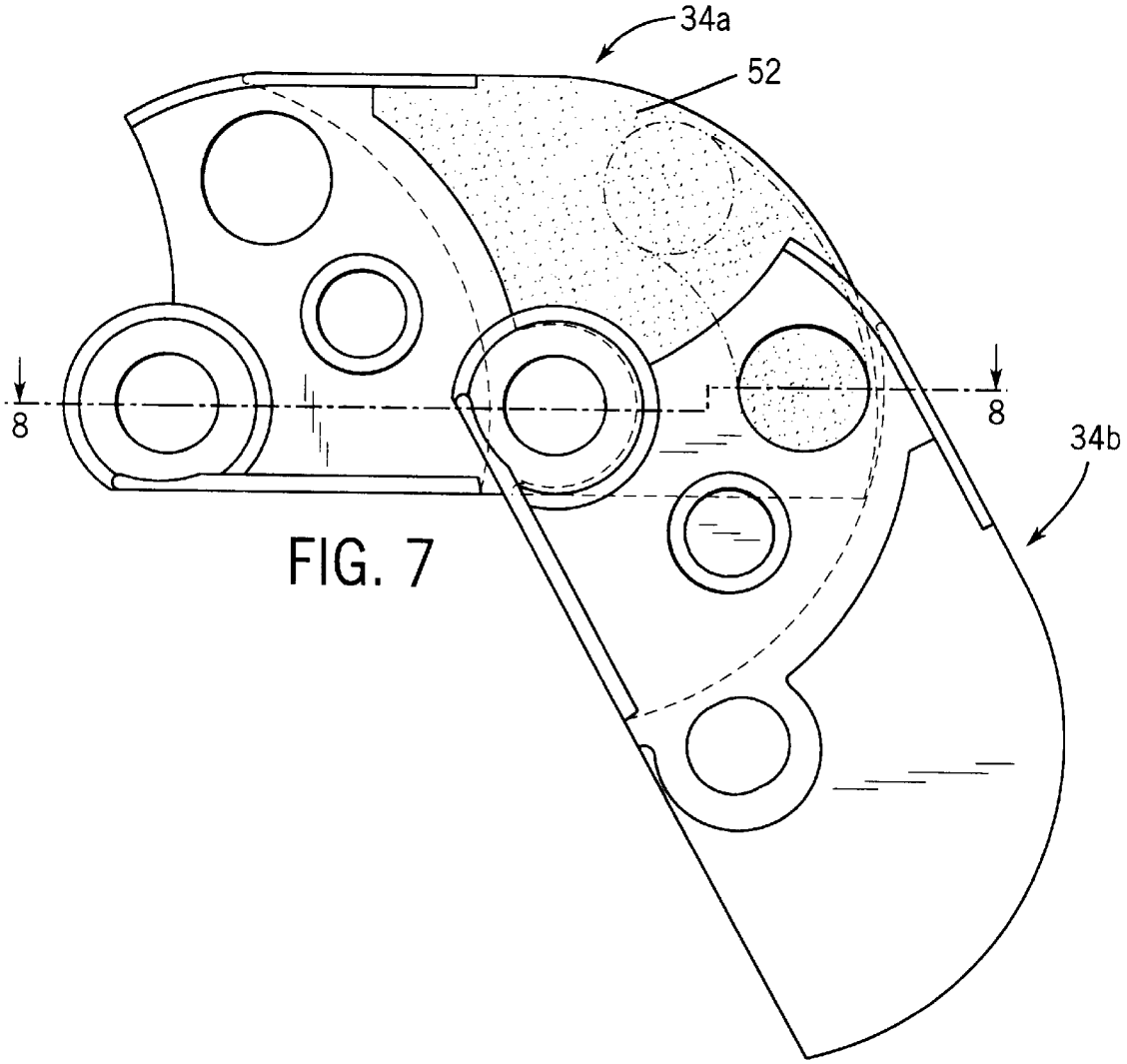
FIG. 7
FIG. 9
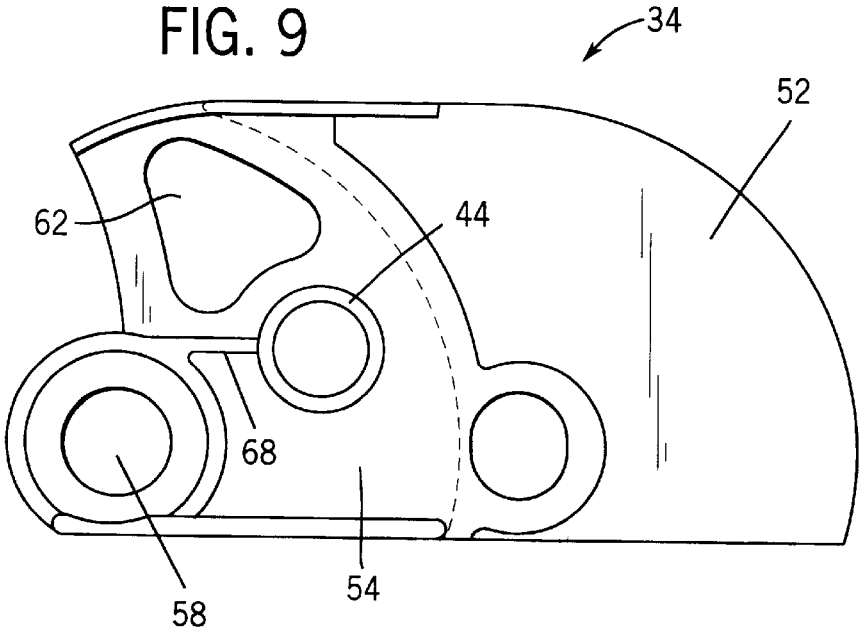

EXTENDED LIFE TRAVELING GRATE SIDE PLATE

CROSS-REFERENCE TO RELATED APPLICATION

This application is based on and claims priority from Provisional Application Serial No. 60/191,650 filed on Mar. 23, 2000.

BACKGROUND OF THE INVENTION

The present invention relates to traveling grates of the type used to convey material through a dryer, a furnace or a discharge zone to a rotary kiln. More particularly, the present invention relates to a side plate construction for a traveling grate that increases the life of the side plate by reducing the temperature gradients across the side plate.

It is conventional in the prior art to provide vertically extending side plates which travel with a traveling grate or grate conveyor to retain the material being conveyed, such as pelletized ore or the like, on the traveling grate. A plurality of such side plates are pivotally connected in overlapped relation to each other along each of the lateral sides of the conveyor. Such overlapped side plates are conventionally positioned laterally on outer ends of the respective through rods or tie rods of the grate conveyor.

In the construction of the prior art, the overlapped side plates of the traveling grate chain assembly experience severe cracking that requires changing side plates after 1½ to 2 years of operation. The severe cracking of the side plates is believed to be caused by several contributing factors. Severe thermal cycling from the inlet of the traveling grate to the discharge end of the grate is an obvious effect of the process that cannot be changed and will probably worsen as the capacity of the traveling grate increases. Large thermal gradients across the side plates are evident from infrared pictures, and the effect is to put a severe strain on the side plates from the differences in the thermal expansion in different areas of the side plate. Stress risers from small radii in the corners of the side plates are inherent in the casting process. Three factors that are not readily obvious but contribute to the cracking problems in conventional side plates are: the restraining effects of the existing gussets, the cooling effects of the existing gussets, and the heat concentration in the back portion of the side plate due to overlapping of the back portion by the front portion of the preceding plate.

Therefore, it is an object of the present invention to provide an improved side plate that promotes heat transfer away from the side plate to reduce temperature gradients across the side plate resulting in reduced thermal stress in the side plate. Further, it is an object of the present invention to provide a side plate that is devoid of any gussets, which allows the side plate a greater degree of expansion and reduces the cooling effect created by the gussets. Further, it is an object of the present invention to provide a side plate that extends the effective life of the side plate and reduces the tendency of the side plate to crack due to the temperature gradients developed over the side plate.

SUMMARY OF THE INVENTION

The present invention is a side plate for use with a traveling grate. The side plate of the present invention decreases the thermal gradients across the front portion of the side plate while allowing heat to be radiated from the overlapped, back portion of the side plate when the side plate is positioned adjacent to a leading side plate.

The side plate of the present invention includes a heat transfer opening formed in the front portion of the side plate. The heat transfer opening is a removed area of the front portion of the side plate and provides an opening through the front portion of the side plate. The heat transfer opening formed in the front portion of the side plate overlays the back portion of the immediately trailing side plate when the side plates are sequentially connected to the continuous length of conveyor chain. The heat transfer opening allows heat to be radiated from the overlapped area of the back portion of the side plate, such that the overlapped area of the back portion can radiate heat effectively to reduce the temperature gradient across the back portion of the side plate to reduce thermal stress in the side plate.

The side plate of the present invention includes a front portion that has the gussets removed such that the entire front portion is generally planar. The removal of the gussets from the front portion of the side plate eliminates the increased heat transfer that previously occurred due to the gussets extending from the front portion. Additionally, the removal of the gussets allows the entire front portion of the front plate to expand and contract at a constant rate.

These two advantages decrease the temperature gradients across the side plate, thereby decreasing the cracking of the side plate and extending the useful life of the side plate.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 7 is a side view illustrating the pivoting movement of a pair of side plates;

FIG. 9 is a side view of a second embodiment of the side plate of the present invention.

DETAILED DESCRIPTION OF THE INVENTION

Figure 1:
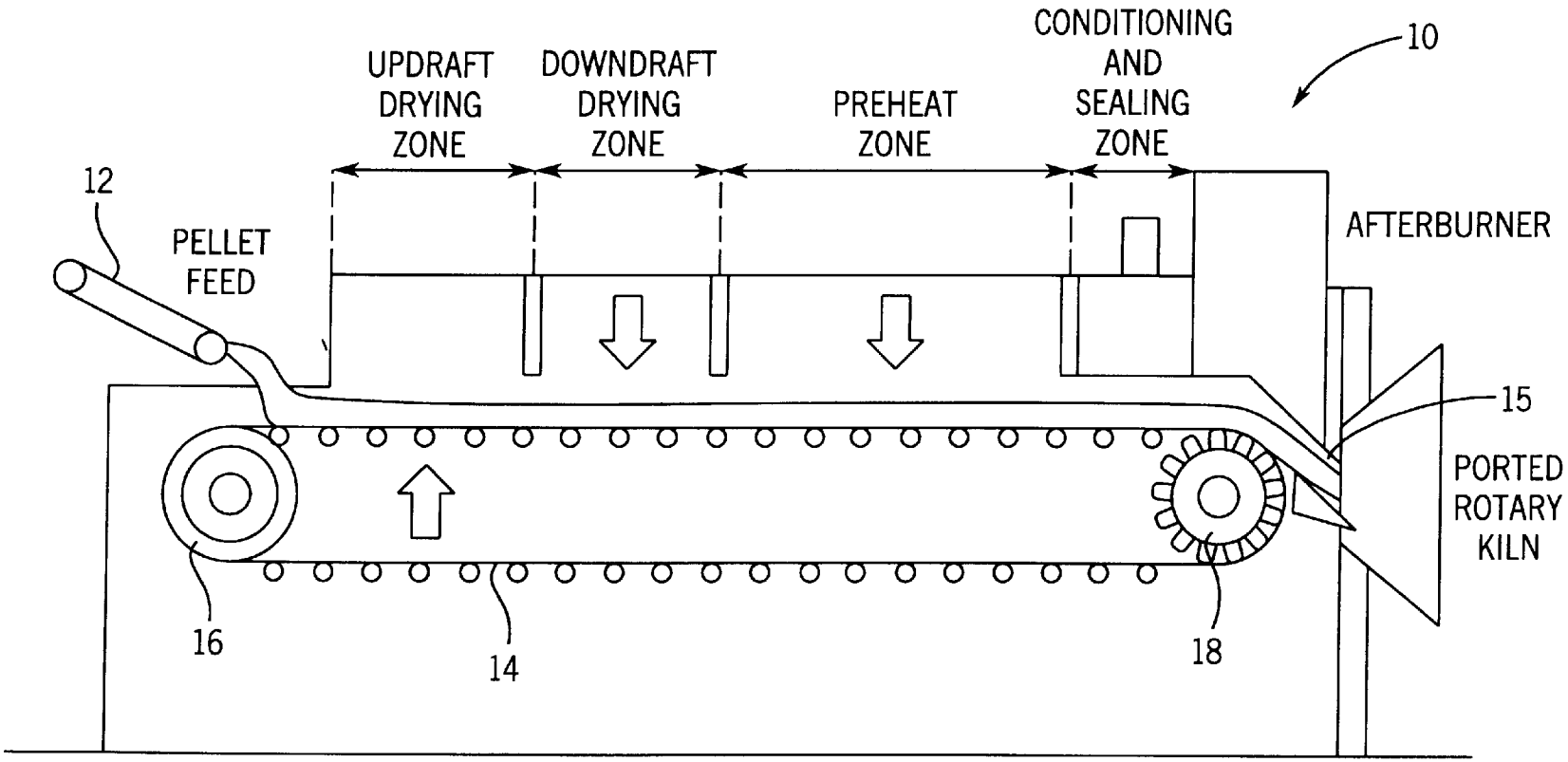
FIG. 1 is a schematic illustration of a traveling grate conveyor that is utilized to feed a stream of pellets along the length of a drying and pre-heating section of an iron-ore processing system used to condition green pellets prior to discharge into a rotary kiln for further processing.

Referring first to FIG. 1, thereshown is the preconditioning section 10 of an iron-ore processing system. The preconditioning section 10 receives a feed of green pellets (iron-ore) from an infeed conveyor 12. The pellets from the infeed conveyor 12 are deposited onto a traveling grate 14 that moves the supply of pellets through the various processing zones contained within the pre-conditioning section 10. For example, as illustrated in FIG. 1, the pellets are dried, preheated and conditioned by a flow of heated air that passes through the pellets and the traveling grate 14 prior to the pellets reaching the discharge end 15 of the preconditioning section 10. As illustrated in FIG. 1, the traveling grate 14 is entrained between an upstream shaft 16 and a downstream, head shaft 18. As can be understood in FIG. 1, the traveling grate 14 is a continuous member that travels around the upstream shaft 16 and the downstream, head shaft 18. In this manner, a continuous traveling chain gate 14 can be used to transport the pellets from the infeed end to the discharge end of the pre-conditioning section 10.

Figure 2:
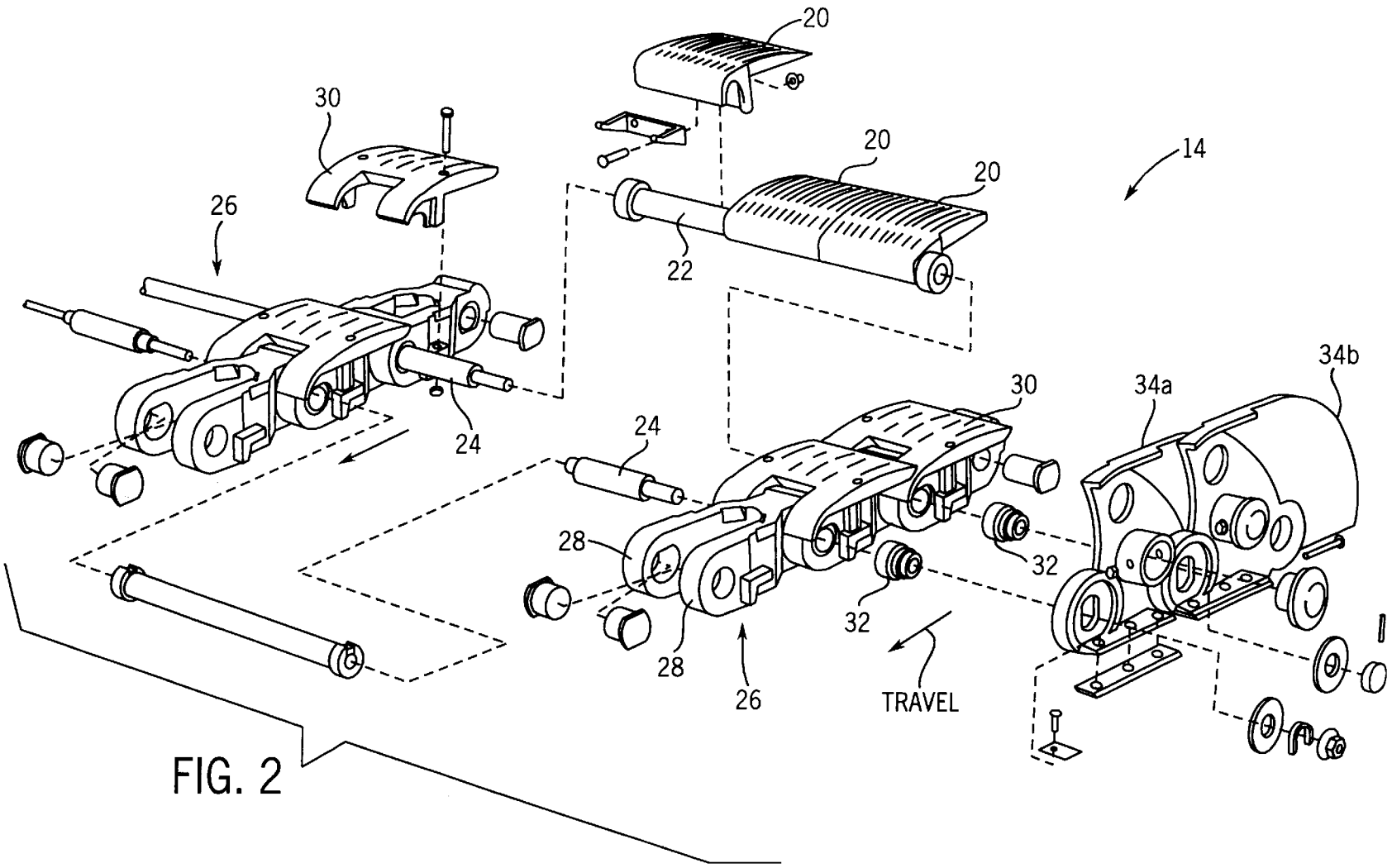
FIG. 2 is an exploded view illustrating the detailed construction of the traveling grate conveyor, including the side plates of the present invention.

Referring now to FIG. 2, thereshown is a portion of the upper run of the traveling grate 14. The traveling grate 14 includes a plurality of conveyor grates 20 that are each supported by a pipe spacer 22. The pipe spacer 22 is coaxially mounted to a pair of tie rods 24 such that the grates 20 extend across the entire width of the traveling grate between the pair of chains 26, as is well known in the art.

The width of the traveling grate is defined by a plurality of spaced chains 26 that are each comprised of a series of joined links 28. In the embodiment of the invention illustrated, six individual chains make up the traveling grate, although only two of the chains 26 are shown in FIG. 2. Each of the chain links 28 includes cover member 30 that protects the individual links from the heated material being transported on the conveyor grates 20.

The tie rods 24 each extend through the chain links 28 and are received within a coaxial spool 32. Mounted on the spaced spools 32 are pivotally connected side plates 34, the details of which will be described in greater detail below. A plurality of pivotally connected side plates 34 are positioned laterally along the length of the two outermost chains to define a continuous outer edge of the grate conveyor and define a sidewall along the entire length of each outermost chain 26. In this manner, the side plates 34 maintain a bed of pellets at a determined depth by preventing the pellets from spilling over the edges of the chains 26. Additionally, the side plates 34 act to keep the heated air passing through the conveyor within the pre-conditioning section 10.

Figure 3:
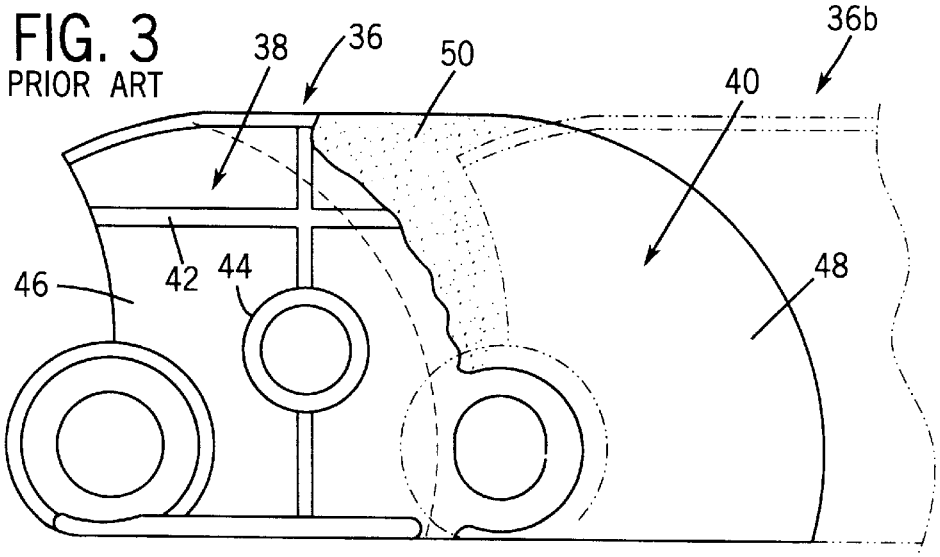
FIG. 3 PRIOR ART
FIG. 3 is a side view of a prior art side plate.

Referring now to FIG. 3, thereshown is a prior art traveling grate side plate 36 that is positioned along the lateral side of the traveling grate to contain the particles being transferred by the traveling grate. As shown in FIG. 3, the side plate 36 includes a front portion 38 and a back portion 40 that are integrally formed as a single, monolithic member. The front portion 38 includes a series of extended gussets 42 at a thrust button hub 44. The gussets 42 and the thrust button hub 44 extend from a planar front face surface 46 that generally defines the front portion 38. The face surface 46 of the front portion 38 is positioned in a plane spaced forward from a flat, back face surface 48 of the back portion 40 of the side plate 36 when the side plate 36 is attached to the chain 26 of the traveling grate, as illustrated in FIG. 2.

As illustrated by the phantom side plate 36*b* in FIG. 3, when a plurality of side plates 36 are connected to the links of the traveling grate, the back portion 40 of the leading side plate 36 is overlapped by the front portion of the trailing side plate 36*b*.

As illustrated in FIG. 3, the majority of the back portion 40 is covered by the overlapping front portion of the trailing side plate 36*b*, as illustrated by the phantom lines in FIG. 3. As shown in FIG. 3, a distorted V-shaped area 50 of the back portion 40 is not overlapped by the trailing side plate 36*b*. Since the V-shaped area 50 is exposed to open air and is not covered by any portion of the trailing side plates 36*b*, this area of the side plate 36 has the highest rate of heat transfer. Considering that the entire inside surface of the back portion 40 is directly exposed to the hot pellets contained on the traveling grate, it can be assumed that the inside surface of the back portion 40 experiences the same heat flux across the entire inside surface. Further, since the entire back portion 40 of the side plate, except for the V-shaped area 50, is covered by the trailing plate, the overlapped area of the back portion 40 is hotter than the V-shaped area 50 because of the overlapping front portion of the trailing side plate acts as a barrier to heat transfer from the side plate. Therefore, the highest temperature occurs in the overlapped area of the back portion 40.

As illustrated in FIG. 3, the gussets 42 extend from the face surface 46 and actually contribute to the amount of strain in the side plate 36 by preventing free expansion of the plate. If there were a uniform temperature across the side plate, the gussets 42 would strengthen the side plate 36, as is their obvious intention. However, the gussets 42 are some 300°–400° cooler than the rest of the front portion 38, since the gussets 42 act as cooling fins. Thus, the gussets 42 add to the large temperature differential between portions of the side plate, which further adds to the strain on the side plate 36.

In addition to acting as cooling fins, the gussets 42 add to the stiffness of the side plate 36. Thus, as the side plate temperature increases, the gussets 42 restrict the thermal expansion of the side plate 36.

The temperature profile of the prior art side plate 36 clearly shows a high concentration of heat in the back portion 40 which is overlapped by the trailing side plate. The V-shaped area 50 of the back portion 40 that is not overlapped, but has the same heat flux applied to it, does not show the same extensive cracking as the overlapped area. The convection and radiation heat transfer that takes place in the V-shaped area 50 keeps the temperature lower than in the overlapped area, thus reducing the temperature gradients and thermal cycling that occurs in this area.

Figure 4:
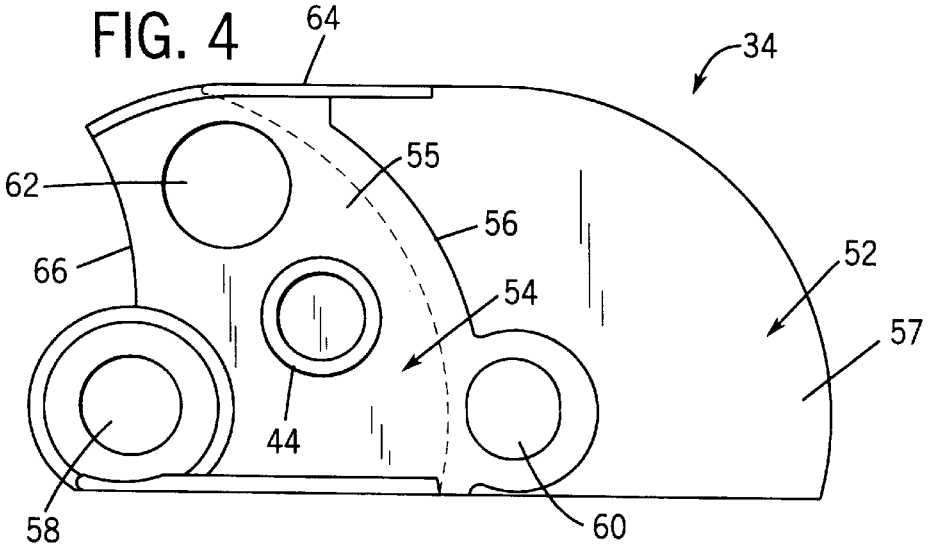
FIG. 4 is a side view of the first embodiment of the side plate of the present invention.
Figure 5:
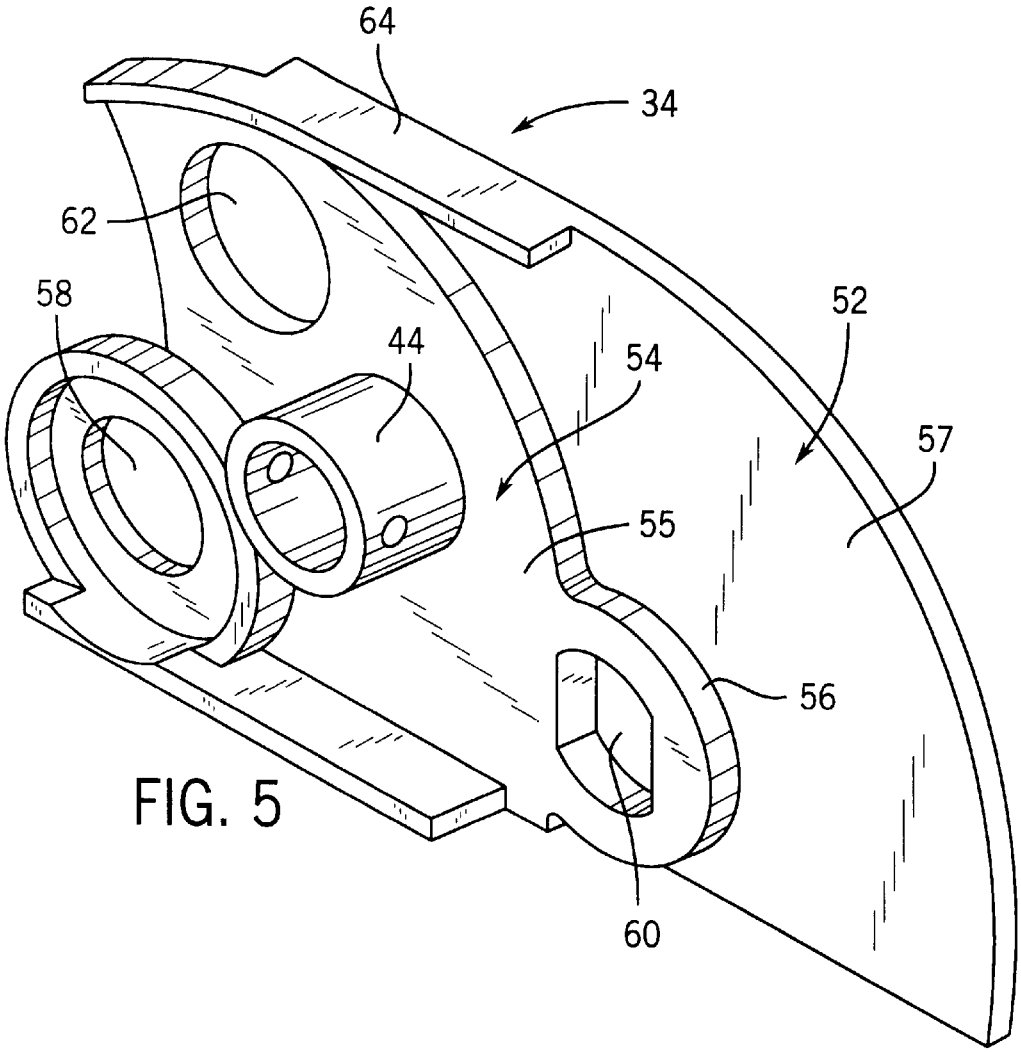
FIG. 5 is a perspective view of the first embodiment of the side plate of the present invention.
Figure 8:
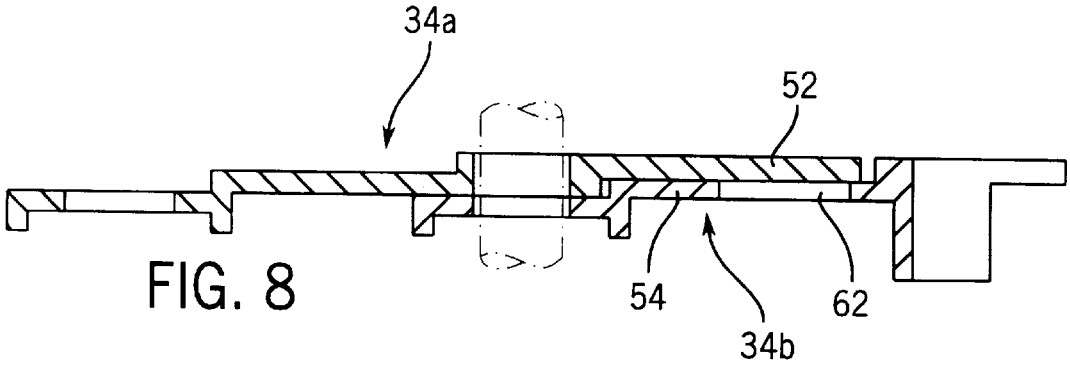
FIG. 8 is a section view taken along line 8—8 of FIG. 7.

Referring now to FIGS. 4 and 5, thereshown is the side plate 34 constructed in accordance with the present invention. As can be seen in FIG. 5, the side plate includes a back portion 52 and a front portion 54. The front portion 54 is defined by a generally planar front face surface 55 that is set forward from the back face surface 57 of the back portion 52 by a shoulder 56. As was the case with the prior art side plate 36, the side plate 34 of the present invention includes a thrust button 44 and a front pivot hole 58. The front portion 54 further includes a rear pivot hole 60. Both the front pivot hole and the rear pivot hole receive one of the tie rods 40 of the traveling grate 14, as was discussed with reference to FIG. 2.

Referring back to FIG. 5, the front portion 54 of the side plate 34 includes a heat transfer opening 62. The heat transfer opening extends through the entire thickness of the side plate 34 and is dimensioned as shown in FIG. 4. In the embodiment of the invention illustrated in FIGS. 4 and 5, the heat transfer opening 62 is a hole formed near both the top edge 64 and the leading edge 66 of the side plate 34.

Figure 6:
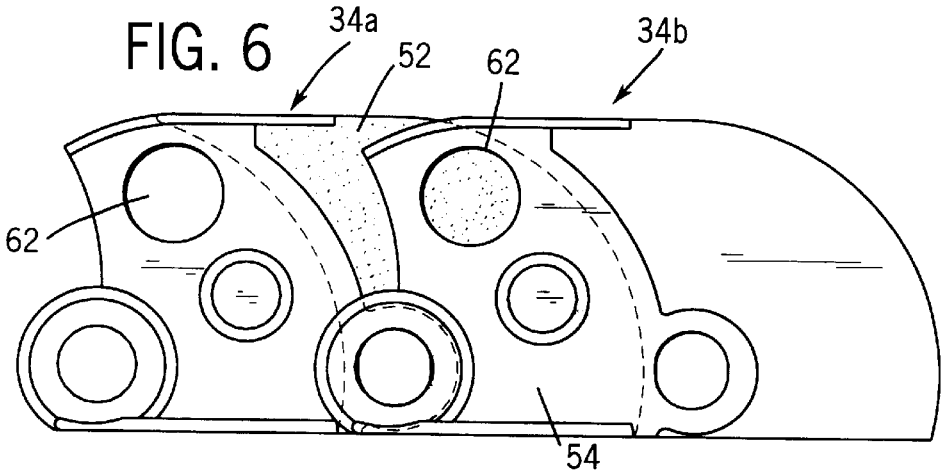
FIG. 6 is a side view illustrating the positioning of a pair of side plates as attached to the traveling grate conveyor.

Referring now to FIGS. 2 and 6, thereshown are a pair of side plates 34*a* and 34*b* mounted adjacent to each other, illustrating the manner in which the side plates 34*a* and 34*b* are attached to the lateral sides of each of the chains 26. It can be understood in FIGS. 2 and 6 that the side plates 34 are sequentially positioned along the entire length of the chain 26, although only two of the side plates 34*a* and 34*b* are illustrated.

Referring now to FIG. 6, the back portion 52 of the leading side plate 34*a* is shaded to illustrate the overlapping nature of the trailing side plate 34*b* relative to the leading side plate 34*a*. As can be seen in FIG. 6, the front portion 54 of the trailing side plate 34*b* overlaps the back portion 52 of the leading side plate 34*a*. When the side plates 34*a* and 34*b* are positioned as shown, the heat transfer opening 62 in the trailing side plate 34*b* provides access for circulating air to the face surface 57 of the back portion 52 of the leading side plate 34*a*. As can be seen in FIG. 6, the heat transfer opening 62 exposes a significant area of the overlapped back portion 52 of the leading side plate 34*a* for convection and radiation heat transfer. Thus, the heat transfer opening 62 allows the overlapped area of the back portion 52 to transfer heat away from the side plate 34*a* in approximately the same manner as the area of the back portion 52 that is not overlapped by the trailing side plate 34*b*. In this manner, the thermal gradients across the back portion 52 are decreased, which in turn decreases the stresses present on the back portion 52.

As can be seen in FIGS. 4 and 5, the front portion 54 of the side plate 34 of the present invention is formed without any gussets, such as those included in the prior art side plate illustrated in FIG. 3. The removal of the gussets from the front portion 54 eliminates the cooling effect the gussets had on the front portion of the prior art side plate 36. Additionally, the elimination of the gussets allows the front portion of the side plate to expand at a more even rate across the entire front portion 54. As discussed previously in connection with the prior art side plate 36, the different rates of expansion due to the gussets resulted in cracking of the front portion of the side plate.

Analysis done on the prior art side plate 36 illustrated in FIG. 3 illustrate a stress level on the order of 67,000 psi, which, for a thermal fatigue situation, is a high level of stress. In the embodiment of the invention illustrated in FIGS. 4 and 5, the gussets have been removed and the heat transfer opening 62 is formed in the front portion 54. These changes to the side plate result in calculated stress levels of approximately 45,000 psi, which is a significant improvement over the prior art illustrated in FIG. 3.

Referring now to FIG. 7, thereshown is the pivoting movement of the trailing side plate 34*b* relative to the leading side plate 34*a* when the conveyor chain travels around either the head shaft or the upstream shaft, as illustrated in FIG. 1. As shown in FIG. 7, the pivoting movement of the pair of side plate 34*a* and 34*b* relative to each other exposes a larger area of the back portion 52, which aids in further heat transfer from the side plate.

Figure 10:
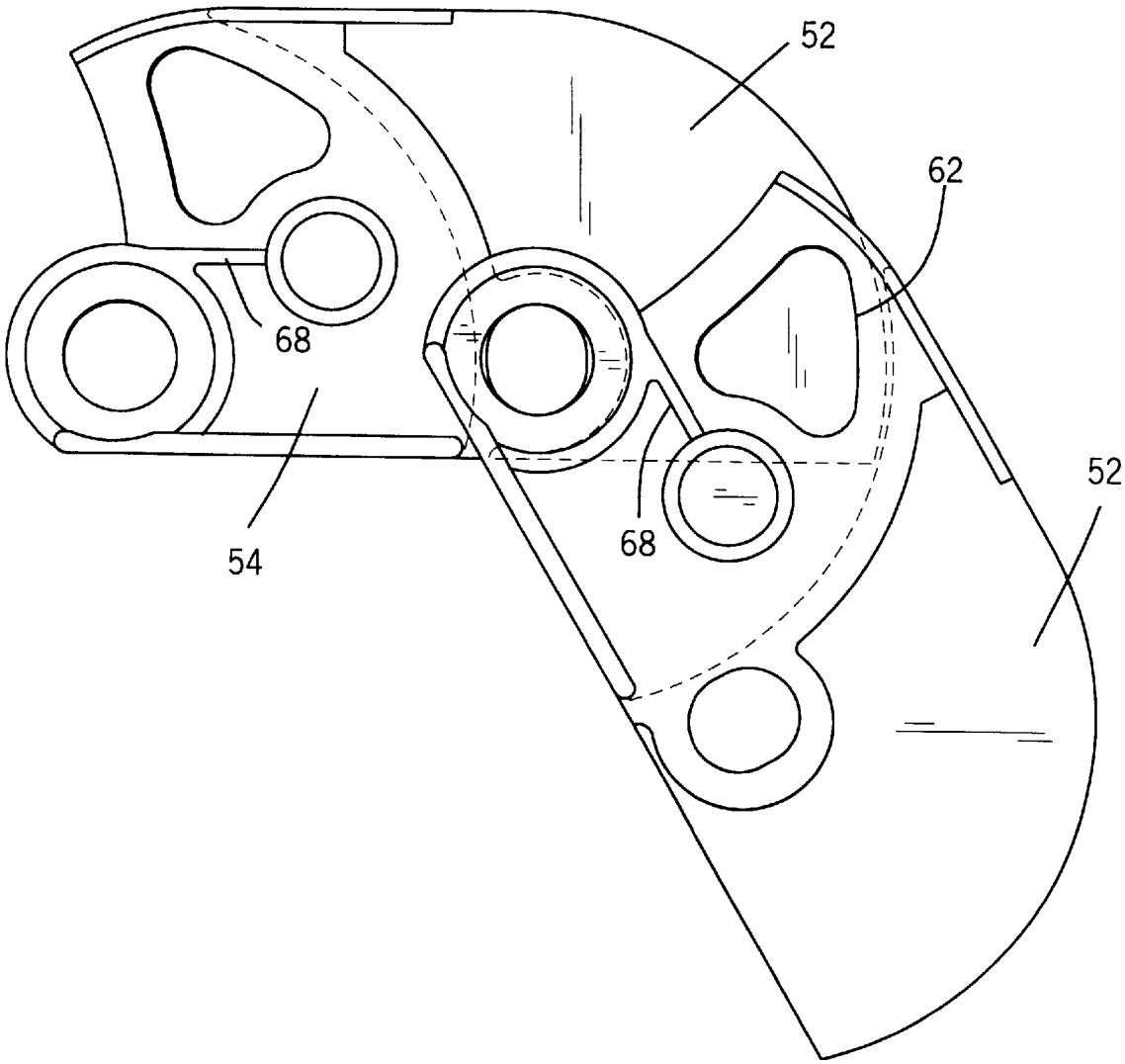
FIG. 10 is a side view illustrating the pivoting movement between a pair of side plates constructed in accordance with the second embodiment of the invention.

Referring now to FIG. 9, thereshown is a second embodiment of the side plate 34 of the present invention. As shown in FIG. 9, a gusset 68 is positioned between the front pivot hole 58 and the thrust button 44. The gusset 68 is included on the side plate if severe chain misalignment is experienced. Chain misalignment typically results in significant loading to the thrust button 44. Inclusion of the gusset 68 strengthens the thrust button, yet since the gusset 68 is positioned in the lower half of the side plate where the temperature gradient is not as severe, the gusset does not significantly contribute to the thermal strain applied to the side plate 34. Typically, the most significant temperature gradient occurs in the top half of the side plate 34. Additionally, the heat transfer opening 62 is shown in FIGS. 9 and 10 as having a larger area and a different shape than the heat transfer opening 62 shown in the first embodiment of FIGS. 4 and 5. The increased area of the heat transfer opening 62 in the second embodiment of FIGS. 9 and 10 further increases the amount of heat that can be radiated away from the back portion 52 of the side plate 34, as illustrated in FIG. 10.

Changing the physical configuration of the side plate to minimize strain due to thermal gradients across the side plate is a different approach to increasing the usable life of the one-piece side plate. Up to now, most of the effort in increasing the useful life of side plate has been in the optimization of material characteristics. Certainly, selecting the best material for the application is a major part of extending the life of side plates. However, combining optimal part configuration to reduce thermal stress with the proper material selection for the application should extend the life of the side plate.

Various alternatives and embodiments are contemplated as being within the scope of the following claims particularly pointing out and distinctly claiming the subject matter regarded as the invention.

I claim:

1. A side plate for use along the lateral sides of a traveling grate conveyor that is used in heat treating materials, the side plate comprising:

a generally planar front portion including a leading edge and a top edge;

a generally planar back portion integrally formed with the front portion, the back portion being recessed from the front portion, wherein the front portion of a first side plate overlies the back portion of a second side plate when the first and second side plates are sequentially attached to the traveling grate conveyor; and a heat transfer opening formed in the front portion of the side plate, the heat transfer opening being spaced from the leading edge and the top edge of the front portion of the side plate such that the back portion of the side plate is exposed through the heat transfer opening when the first and second side plates are sequentially attached to the traveling grate conveyor.

2. The side plate of claim 1 wherein the heat transfer opening is formed along an upper half of the front portion of the side plate.

3. A side plate for use along the lateral sides of a traveling grate conveyor that is used in heat treating materials, the side plate comprising:

a generally planar front portion;

a generally planar back portion integrally formed with the front portion, the back portion being recessed from the front portion, wherein the front portion of a first side plate overlies the back portion of a second side plate when the first and second side plates are sequentially attached to the traveling grate conveyor; and a heat transfer opening formed in the front portion of the side plate, the heat transfer opening being positioned such that the back portion of the side plate is exposed through the heat transfer opening when the first and second side plates are sequentially attached to the traveling grate conveyor, wherein the front portion of the side plate is void of gussets.

4. A side plate for use along the lateral sides of a traveling grate conveyor that is used in heat treating materials, the side plate comprising:

a generally planar front portion;

a generally planar back portion integrally formed with the front portion, the back portion being recessed from the front portion, wherein the front portion of a first side plate overlies the back portion of a second side plate when the first and second side plates are sequentially attached to the traveling grate conveyor; and a heat transfer opening formed in the front portion of the side plate, the heat transfer opening being positioned such that the back portion of the side plate is exposed through the heat transfer opening when the first and second side plates are sequentially attached to the traveling grate conveyor, wherein the heat transfer opening is circular.

5. In a traveling grate conveyor having a plurality of chains extending lengthwise of the conveyor and defining a pair of continuous lateral edges, each lateral edge defined by a series of sequentially overlapping side plates attached to the chain to create a bed of heated material on the traveling grate conveyor, each of the side plates including a front portion having a leading edge and a top edge and a back portion, the front portion of each trailing plate overlying a substantial amount of the back portion of a leading side plate, the improvement comprising:

a heat transfer opening formed in the front portion of each side plate, the heat transfer opening being spaced from the leading edge and the top edge of the front portion of the side plate such that the back portion of the leading side plate is exposed through the heat transfer opening of the front portion of the trailing side plate.

6. The improvement of claim 5 wherein the heat transfer opening is formed along an upper half of the front portion of each side plate.

7. In a traveling grate conveyor having a plurality of chains extending lengthwise of the conveyor and defining a pair of continuous lateral edges, each lateral edge defined by a series of sequentially overlapping side plates attached to the chain to create a bed of heated material on the traveling grate conveyor, each of the side plates including a front portion and a back portion, the front portion of each trailing plate overlying a substantial amount of the back portion of a leading side plate, the improvement comprising:

a heat transfer opening formed in the front portion of each side plate, the heat transfer opening being positioned such that the back portion of the leading side plate is exposed through the heat transfer opening of the front portion of the trailing side plate, wherein the front portion of the side plate is devoid of gussets.

8. In a traveling grate conveyor having a plurality of chains extending lengthwise of the conveyor and defining a pair of continuous lateral edges, each lateral edge defined by a series of sequentially overlapping side plates attached to the chain to create a bed of heated material on the traveling grate conveyor, each of the side plates including a front portion and a back portion, the front portion of each trailing plate overlying a substantial amount of the back portion of a leading side plate, the improvement comprising:

a heat transfer opening formed in the front portion of each side plate, the heat transfer opening being positioned such that the back portion of the leading side plate is exposed through the heat transfer opening of the front portion of the trailing side plate, wherein the heat transfer opening is circular.

9. In a traveling grate conveyor having a plurality of chains extending lengthwise of the conveyor and defining a pair of continuous lateral edges, each lateral edge defined by a series of sequentially overlapping side plates attached to the chain to create a bed of heated material on the traveling grate conveyor, each of the side plates including a front portion and a back portion, the front portion of each trailing plate overlying a substantial amount of the back portion of a leading side plate, the improvement comprising:

a heat transfer opening formed in the front portion of each side plate, the heat transfer opening being positioned such that the back portion of the leading side plate is exposed through the heat transfer opening of the front portion of the trailing side plate, wherein the front portion of each side plate is generally planar.

* * * * *